US006354023B1

(12) United States Patent
Trahan et al.

(10) Patent No.: US 6,354,023 B1
(45) Date of Patent: Mar. 12, 2002

(54) SNOW GROOMERS AND CONTROL SYSTEM THEREFOR

(75) Inventors: Claude Trahan, Granby; Michel Pelletier, Canton de Shefford, both of (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/868,187

(22) PCT Filed: Jan. 8, 1999

(86) PCT No.: PCT/CA99/00019

§ 371 Date: Jun. 15, 2001

§ 102(e) Date: Jun. 15, 2001

(87) PCT Pub. No.: WO00/36250

PCT Pub. Date: Jun. 22, 2000

(30) Foreign Application Priority Data

Dec. 15, 1998 (CA) ..... 2256172

(51) Int. Cl.[7] ..... E04H 5/00

(52) U.S. Cl. ..... 37/219; 37/234; 37/466; 701/50

(58) Field of Search ..... 37/219, 196, 234, 37/382, 412, 413, 414, 415, 416, 466; 172/2; 701/50

(56) References Cited

U.S. PATENT DOCUMENTS

| | | | | |
|---|---|---|---|---|
| 3,585,319 | A | 6/1971 | Payerle | |
| 4,026,048 | A | 5/1977 | Hill et al. | |
| 4,237,629 | A | 12/1980 | Schmidt | 37/41 |
| 4,574,651 | A | 3/1986 | Nordström | |
| 5,576,704 | A | 11/1996 | Baker et al. | 341/20 |
| 5,666,586 | A | 9/1997 | Lauer et al. | 74/523 |
| 5,680,715 | A | 10/1997 | Thiboutot et al. | 37/219 |

FOREIGN PATENT DOCUMENTS

| | | |
|---|---|---|
| DE | 42 04 223 | 8/1993 |
| DE | 295 02 639 | 5/1995 |
| DE | 296 00 905 | 5/1996 |
| EP | 0 140 139 | 5/1985 |
| GB | 2 244 742 | 12/1991 |

OTHER PUBLICATIONS

International Search Report, Sep. 6, 1999.

*Primary Examiner*—Christopher J. Novosad
(74) *Attorney, Agent, or Firm*—Pillsbury Winthrop LLP

(57) ABSTRACT

The invention relates to an improved snow grooming vehicle featuring a multifunction joystick adapted to selectively control a plurality of independent functions of various work implements installed on the snow grooming vehicle. More specifically, the multifunction joystick is adapted to select specific functions of a work implements and apply the movements of the joystick to these specific functions. If a new function is selected, the movements of the joystick are applied to the newly selected function while disabling the previously selected function From a single joystick, the operator may control a wide array of functions of the work implements installed on the snow grooming vehicle.

49 Claims, 4 Drawing Sheets

SNOW GROOMERS AND CONTROL SYSTEM THEREFOR

This application is the National Phase of International Application PCT/CA99/00019 filed Jan. 8, 1999 which designated the U.S. and that International Application was published under PCT Article 21(2) in English.

FIELD OF THE INVENTION

The invention relates to snow groomers and to implement controls for snow groomers and for other utilitarian motorized vehicle.

BACKGROUND OF THE INVENTION

Snow groomers are tracked vehicles used for preparing snow surfaces such as ski slopes, cross-country ski trails, snow mobile trails and the like to obtain a smooth compacted snow covered surface of a desired configuration to facilitate the practice of winter sports and reduce the risks of accidents while practicing these winter sports. Snow groomers are normally equipped with a variety of snow grooming and conditioning implements which are operated from the operator's cabin enabling the operator to control these implements while the snow groomer is moving.

Joysticks are commonly used to control work implements on snow groomers and on a variety of utilitarian vehicles. The lateral motion and the fore and aft motion of the joystick normally control the hydraulic system of a single work implement. In some instances, the joystick will be adapted to control a second implement by rotating the joystick clockwise or counterclockwise while still controlling the primary implements.

Joysticks are also constructed with a base featuring a cardan joint or universal joint to provide motion of the stick in all directions and feature electric position sensors linked to the shaft of the joystick as is disclosed U.S. Pat. No. 5,576,704 to Baker et al. The relative position of the joystick in relation to the position sensors is translated by a control means into motion of a specific work implement and in some instances, the joystick affords some degree of control over the acceleration and deceleration of the specific work implement. U.S. Pat. No. 4,574,651 to Lennart et al. discloses a control stick for a fighter aircraft that controls a plurality of functions. An array of selector switches and buttons are disposed either on the handle or in close proximity of the handle enabling the pilot to control many functions without removing his hand from the control stick. The control stick has two separate portions. The lower portion only moves fore and aft along a single axis and controls the engine throttle. The upper portion of the control stick is swingable along two axes similar to a conventional joystick and its sole purpose is to control the radar orientation and range. Buttons and switches on the control stick unit operate control instrumentalities and radar mode selection while the joystick maintains radar control.

UK Patent Application GB 2 244 742A discloses a joystick for controlling a cleaning vehicle. The joystick uses a first microswitch 170 and a second microswitch 190, both connected to a control module 198 to control various cleaning implements and operations.

In the presence of a plurality of independent work implements requiring joystick controls, a plurality of joysticks are usually installed, one for each implement. It is not uncommon to see up to five joysticks in a single operator's cabin. This array of joystick controls is cumbersome and less than efficient in a small operator's cabin.

OBJECTS AND STATEMENT OF THE INVENTION

It is thus an object of the invention to provide an improved snow grooming vehicle.

It is another object of the invention to provide a multifunction joystick control system adapted to selectively control a plurality of independent functions.

It is another object of the invention to provide a multifunction joystick control system adapted to combine hydraulic control for some implement functions with electrical control for other implement functions.

Yet another object of the invention is to provide improved implements controls for utilitarian vehicles.

It is also an object of the invention an improved snow grooming vehicle adapted to selectively control a plurality of independent functions using a single multifunction joystick.

As embodied and broadly described herein, the invention provides a snow grooming vehicle having a frame supported and propelled by ground engaging tracks, an operator's cabin mounted to the frame, implement coupling means for at least one snow working implement carried by the frame, and at least two sets of implement actuators which are subject to operational control by the operator from within the operator's cabin. Each set of implement actuators being controllable by a joystick independently of the control of any other set of implement actuators. The snow grooming vehicle has an engine for driving the ground engaging tracks, the joystick has a hand grip portion positioned for convenient manipulation by the operator when sitting into the operator's cabin in a normal command position. Electrical transducer means are operatively associated with the joystick for generating an electrical signal representative of the position of the joystick. Manual control switching means operable by the operator from its normal command position are provided for selecting a set of implement actuators of which the operator desires to change the condition by means of the joystick thereby adjusting the position or setting of an implement according to the position of the joystick. There is a controller having at least two inputs and one output and generating an output signal representative of the position of the joystick for operatively controlling the set of implement actuators selected by the operator. The manual control switching means are coupled to a first input of said controller; the electrical signal produced by the electrical transducer means are coupled to a second input of the controller, whereby while the manual control switching means is actuated, the controller generates an output signal representative of the position of the joystick which is used to operatively control a predetermined set of implement actuators; the joystick being adapted to control at least one other set of implement actuators when the manual control switching means is not actuated.

Preferably, one snow grooming implement is a front snow blade and the other set of implement actuators which are controlled by the joystick when the manual control switching means is not actuated consists of a first hydraulic cylinder which sets the height of the front snow blade and a second hydraulic cylinder which sets the tilt angle of the front snow blade.

Advantageously, the first and second hydraulic cylinders are controlled by a set of hydraulic control valves which are mechanically linked to, and controlled by the joystick and rendered inoperative whenever the manual control switching means is actuated.

As embodied and broadly described the invention also provides a snowgrooming vehicle having an internal combustion engine, a frame, an operator's cabin supported by the frame, a set of ground engaging tracks, a drive mechanism linking the engine to the ground engaging tracks enabling the vehicle to move on snow, implement coupling means for at least one implement, the implement being subject to functional control by the operator from within the operator's cabin, a multifunction joystick control system for selectively controlling an implement carried by the implement coupling means. The multifunction joystick control system comprises a joystick having a hand grip portion positioned for convenient manipulation by the operator when sitting into the operator's cabin in a normal command position, manual control switching means operable by the operator from the normal command position for selecting a function of an implement that the operator desires to control by normal bi-axial manipulation of the joystick, a controller for generating an output signal which is used for effecting the operational control of the function of an implement selected by the operator whenever the manual control switching means is actuated. The multifunction joystick control system is adapted to also control the operation of at least one other function of an implement by normal bi-axial manipulation of the joystick while the manual control switching means is not actuated.

Preferably, the multifunction joystick control system further comprises a set of electrical transducers operatively associated with the joystick for generating an electrical signal representative of the position of the joystick, the electrical signal generated by the set of electrical transducers being coupled to a second input of the controller.

Advantageously, the manual control switching means generates an electrical signal representative of the selected function of an implement, and this electrical signal generated by the manual control switching means is coupled to a first input of the controller.

The invention also provides a multifunction joystick control system for a snow grooming vehicle which has a frame, ground engaging tracks, an operator's cabin, an engine for driving the vehicle, implement coupling means for at least one snow grooming implement and at least two sets of implement actuators separately controlled by the operator, each set of implement actuators being controllable by a joystick. The multifunction joystick control system has a joystick having a hand grip portion positioned for convenient manipulation by the operator when sitting into the operator's cabin in a normal command position, a set of electrical transducers operatively associated with the joystick for generating an electrical signal representative of the position of the joystick, a first manual control switching means operable by the operator from the normal command position for selecting a first set of implement actuators that the operator desires to operationally control, the first manual control switching means generating an electrical signal representative of the first set of implement actuators, and a controller having at least two inputs and one output and generating an output signal for effecting the operational control of the set of implement actuators selected by the operator. The electrical signal generated by the first manual control switching means is coupled to a first input of the controller. The electrical signal generated by the set of electrical transducers is coupled to a second input of the controller. The controller generates a first output signal when the first manual control switching means is actuated, the first output signal being representative of the position of the joystick and being used to control the operation of the first set of implement actuators. The multifunction joystick control system is adapted to control the operation of at least one other set of implement actuators as a function of the position of the joystick when the first manual control switching means is not actuated.

Preferably, the other set of implement actuators consists of a set of hydraulic cylinders which require control by the operator for proper operation of the utilitarian vehicle. The multifunction joystick control system also comprises a hydraulic circuit for operating the hydraulic cylinders, control valve means operatively associated with the joystick for controlling hydraulic fluid supply through said hydraulic circuit to the hydraulic cylinders as a function of the position of said joystick and disabling means for disabling the control valve means when the first manual control switching means is actuated.

Advantageously, the manual control switching means comprises at least one push button located on the hand grip portion of the joystick.

As embodied and broadly described, the invention also provides a multifunction joystick control system for a utilitarian vehicle having at least one implement and at least two sets of implement actuators which are subject to operational control by the operator from within an operator's cabin in the utilitarian vehicle. Each set of implement actuators is controllable by a joystick independently of the control of any other set of implement actuators. The multifunction joystick control system features a joystick having a hand grip portion positioned for convenient manipulation by the operator when sitting into the operator's cabin in a normal command position, a set of electrical transducers operatively associated with the joystick for generating an electrical signal representative of the position of the joystick, a first manual control switching means operable by the operator from the normal command position for selecting a first set of implement actuators that the operator desires to operationally control, the first manual control switching means generating an electrical signal representative of the first set of implement actuators, a controller having at least two inputs and one output and generating an output signal for effecting the operational control of the set of implement actuators selected by the operator. The electrical signal generated by the first manual control switching means is applied to a first input of the controller. The electrical signal generated by the set of electrical transducers being applied to a second input of the controller. The controller generates a first output signal when the first manual control switching means is actuated, the first output signal being representative of the position of said joystick and being used to control the operation of the first set of implement actuators. The multifunction joystick control system is adapted to control the operation of at least one other set of implement actuators when the first manual control switching means is not actuated.

Other objects and features of the invention will become apparent by reference to the following description and the drawings.

BRIEF DESCRIPTION OF THE DRAWINGS

A detailed description of a preferred embodiment of the present invention is provided herein below, by way of example only, with reference to the accompanying drawings, in which.

Figure 1:
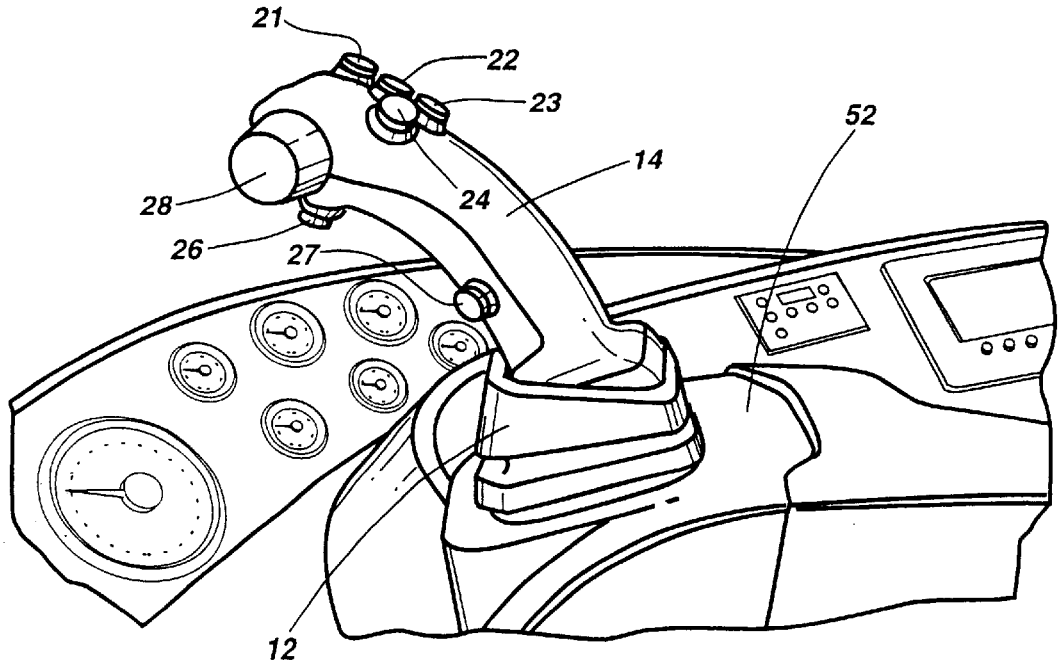
FIG. 1 is a perspective view illustrating a multifunction joystick according to the invention, installed in an operator's cabin.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

Figure 2:
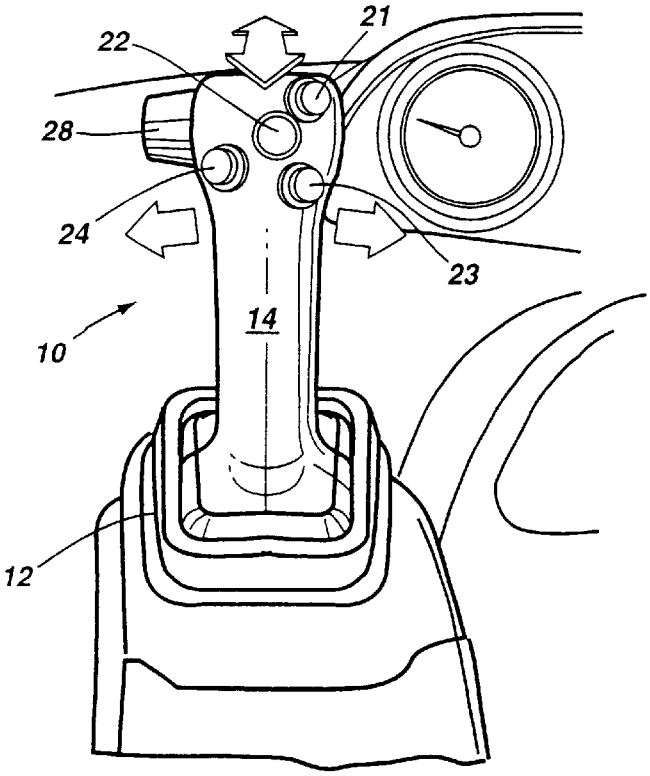
FIG. 2 is a front elevational view of the multifunction joystick illustrated in FIG. 1.
Figure 3:
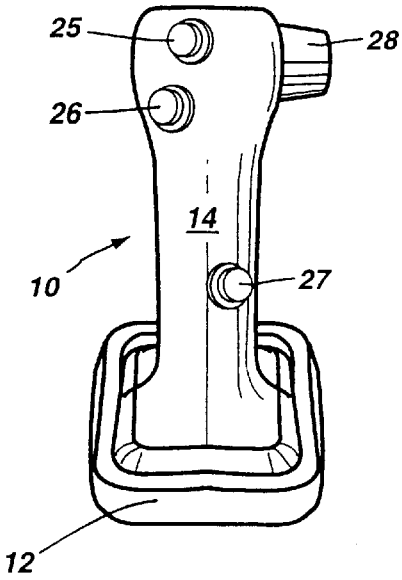
FIG. 3 is a rear elevational view of the multifunction joystick illustrated in FIG. 1.

With reference to FIG. 1, 2 and 3, a novel multifunction joystick is designated generally by reference numeral 10. Joystick 10 has a handle portion 14 which can be manipulated by the operator from its normal position. Joystick 10 is adjustably mounted to a side arm 52 of the operator seat in a snow groomer cabin and all work implements of the snow groomer are controlled and, in accordance with the invention, actuated by the operator via the multifunction joystick 10. Although the invention is described in relation with tracked vehicles used for grooming snow trails, ski slopes and the like, control system in accordance with this invention may find application in any type of utilitarian vehicles featuring work implements that require segregated joystick control.

Figure 5:
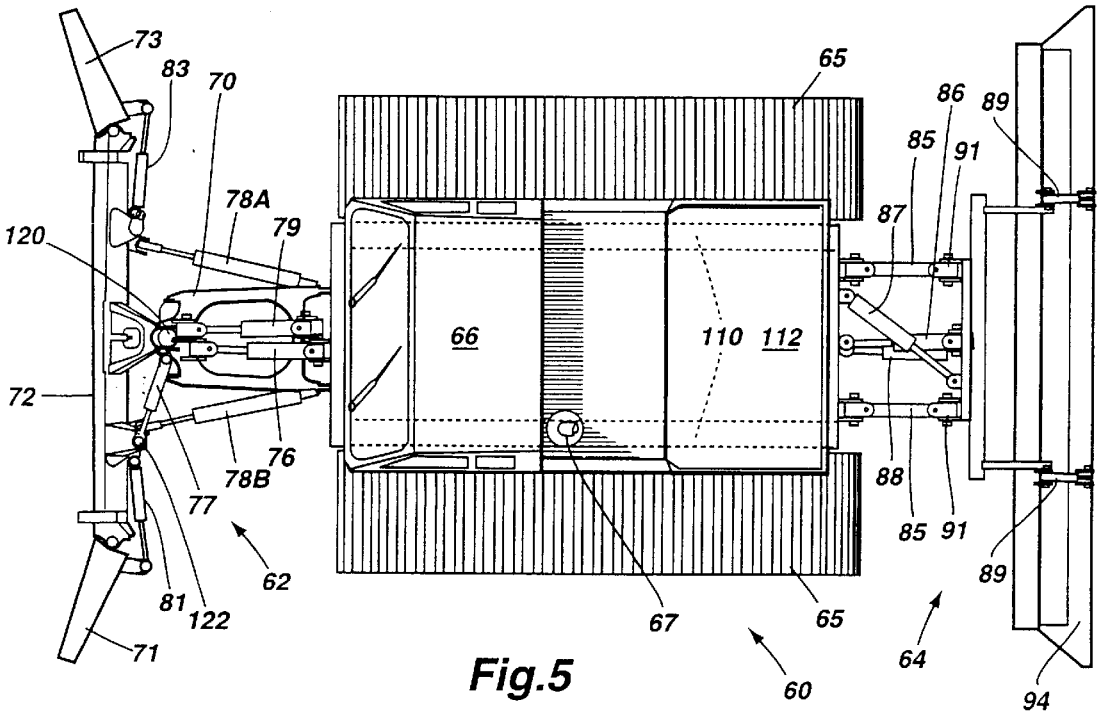
FIG. 5 is a top plan view illustrating the snow groomer shown in FIG. 4.
Figure 4:
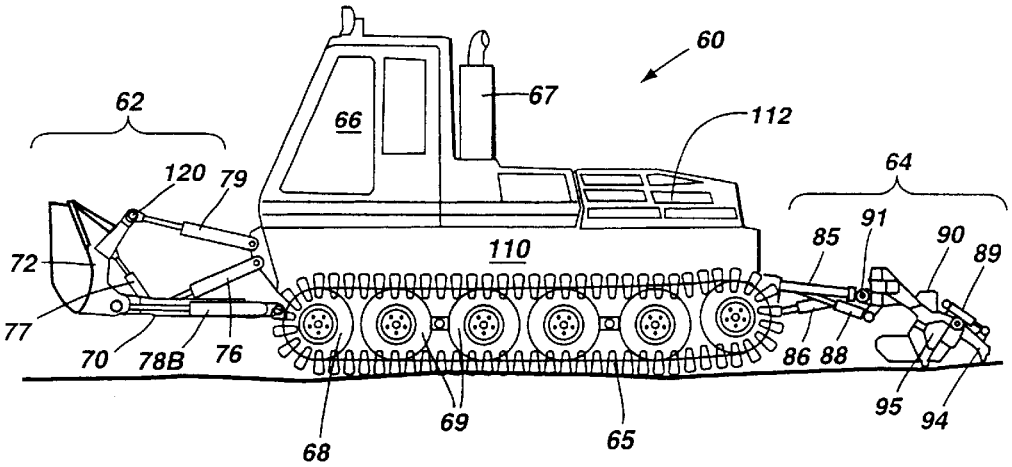
FIG. 4 is a side elevational view illustrating a typical snow groomer with a front snow blade and a rear snow grooming accessory.

Referring to FIGS. 4 and 5, a conventional snow groomer 60 is illustrated. The snow groomer 60 is constructed around a narrow frame 110 on which the operator's cabin 66 is mounted. An internal combustion engine is positioned in the mid-section of snow groomer 60 and a muffler 67 is provided to evacuate the exhaust gas produced by the internal combustion engine. At the rear of snow groomer 60 is a utility compartment 112 provided to carry tools and equipment. Snow groomer 60 is supported and propelled by a pair of wide snow engaging tracks 65 and their associated tandem wheels 69, single wheels 68 and suspension system (not shown) on frame 110 in accordance with conventional practice.

Snow groomer 60 is shown with a front work implement 62 and rear work implement 64. Front work implement 62 consists of a large front snow blade 72 with adjustable wings 71 and 73. Front blade 72 is coupled to frame 110 by means of a single-arm frame 70 on an attachment point 120 consisting of a balljoint which enables partial rotation of front blade 120 about a vertical axis, a transverse axis and a longitudinal axis. Front blade 72 may be raised or lowered by a hydraulic cylinder 76 connected at one end to the upper part of the frame 110 of the snow groomer 60 and at the other end to the lower part of the front blade 72. Blade 72 may be pivoted about the snow groomer's longitudinal axis so that one side of the blade 72 is higher than the other. This is accomplished by actuating a tilt hydraulic cylinder 77 connected between the frontal extremity of the single-arm frame 70 and an attachment point 122 of blade 72. Tilt hydraulic cylinder 77 imparts a rotary motion to the front blade 72 about a longitudinal axis of the snow groomer 60. This adjustment of the front blade 72 is referred to, in the industry, as tilting the front blade 72.

The angle of the front blade 72 in relation to the longitudinal axis of the snow groomer 60 is also adjustable using a pair of angler hydraulic cylinders 78A and 78B located on both sides of the single-arm frame 70 which imparts rotational motion to the blade 72 around a vertical axis. The pitch angle of the blade 72 is adjustable by a pitch hydraulic cylinder 79 linking the upper part of the frame 110 with the upper part of the blade 72. Finally, the angle of the blade wings 71 and 73 may be adjusted by left-wing hydraulic cylinder 81 and right-wing hydraulic cylinder 83 which open or close the angle of the blade wings 71 and 73.

The rear work implement 64 is mounted to the snow groomer 60 by means of a conventional double-arm frame 85 acting as a implement coupling means. Rearwork implement 64 consists of a tiller 90 provided with a variety of hydraulic adjustments. A first hydraulic cylinder 86 serves to raise and lower the double-arm frame 85 thereby raising and lowering tiller 90 relative to the ground. A second hydraulic cylinder 87, positioned diagonally between the two arms of the double-arm frame 85, is provided to laterally displace the tiller 90 in relation to the snow groomer 60. A third hydraulic cylinder 88 attached directly to the tiller 90 on one side and to the frame 110 of the snow groomer 60 on the other side provides depth control of the tiller 90. When actuated, the hydraulic cylinder 88 imparts a rotation of the tiller 90 about the axis defined by the two attachment points 91 of tiller 90 to the rear double-arm frame 85. This rotation of tiller 90 either increases the depth of tilling of the snow or reduces it. Finally, a pair of hydraulic cylinders 89, positioned atop tiller 90, actuate the tiller rear flap 94 which increases or decreases the volume of the snow chamber 95.

As noted above, the illustrated work implements are well known in the art and can be found in commercially available snow groomers. Otherwork implements are also available, such as front snow blowers or compactors. These work implements are normally controlled by the same hydraulic system using separate manual controls, one for each implement. Most of these work implements require joystick control in that they cannot be fully controlled merely with a single direction lever or control switch. In other words, they are controllable as a function of the bi-axial position or motion of a joystick.

An improved snow groomer, in accordance with this invention uses instead a central system which has a multifunction joystick 10 for all implements. As shown in FIGS. 1, 2, and 3, joystick 10 is swingable relative to the base 12 about mutually perpendicular axes that intersect near the base 12. The multifunction joystick 10 is, in this case, swingable about a fore-and-aft extending axis and a laterally extending axis. The joystick 10 may be configured for right hand or left hand actuation depending on where it will be located relative to the operator. In this example, a right hand multifunction joystick is illustrated.

The joystick 10 actuates, as a primary function, a conventional four-way hydraulic valve which controls the flow of hydraulic fluid to a set of hydraulic cylinders thereby controlling the actions of these implement actuators. In addition to joystick 10, the control system uses one or more push buttons or other type of manual control switching means to select a given function. In the illustrated embodiment, seven push buttons are shown numbered 21 to 27 which are mounted to the upper part of joystick 10. Out of these seven push buttons, four are used to select a function which requires inputs from the movements of joystick 10. The other three buttons select functions that do not require input from joystick 10. Four buttons numbered 21, 22, 23, and 24, are located on the portion of joystick 10 facing the operator (FIG. 2) and are positioned to be easily reachable by the thumb of the right hand of the operator; and three buttons, numbered 25, 26, and 27, are positioned on the portion of the multifunction joystick 10 facing away from the operator (FIG. 3). Buttons 24 and 25 are preferably actuated by the forefingers while button 27 may be actuated by either the forefingers or the thumb. The multifunction joystick 10 also features a knob 28 provided for setting the engine power output which overrides the gas pedal or the directional levers of the snow groomer 60. Rotating knob 28 counterclockwise or upwards with the right hand thumb increases the engine power output while rotating it clockwise or downwards decreases engine power output.

By default, that is when none of the four buttons requiring inputs from the movements of joystick 10 are actuated, joystick 10 controls the movements of front blade 72. Pushing forward on joystick 10 will actuate hydraulic cylinder 76 and lower front blade 72 while pulling on joystick 10 backward will actuate hydraulic cylinder 76 in the opposite direction and raise front blade 72. Moving joystick 10 laterally to the right or to the left actuates tilt hydraulic cylinder 77 thereby tilting front blade 72 by raising or lowering the left side of blade 72 which rotates about its attachment point 120 to the single-arm frame 70. Needless to say, moving joystick 10 to the left side, lowers the left end of blade 72, and vice versa.

Push button 24 is dedicated to blade angle adjustment and pitch angle adjustment. Pressing button 24 and keeping it pressed disables the default function of the multifunction joystick 10, namely the raising and lowering and the tilting of the front blade 72 by actuating an electro-mechanical valve which cuts off the supply of hydraulic fluid to four-way hydraulic valve of joystick 10. With button 24 pressed, the movements of joystick 10 will act upon a pair of angler hydraulic cylinders 78A and 78B and to pitch hydraulic cylinder 79. Electrical transducers located at the base 12 of joystick 10 send signals representative of the position of joystick 10 to controller 100 (FIG. 9) which send a signal representative of the bi-axial position of joystick 10 to an electro-mechanical four-way hydraulic valve which controls the supply of hydraulic fluid to hydraulic cylinders 78A, 78B and 79. This transfer of function of the multifunction joystick 10 will hereafter be described in greater detail with reference to FIGS. 6 to 9. A lateral motion of joystick 10 to the right or to the left, acts upon hydraulic cylinders 78A and 78B to adjust the angle of front blade 72 in relation to the longitudinal axis of the snow groomer 60. The pair of hydraulic cylinders 78A and 78B are part of the same hydraulic circuit and work in tandem. When cylinder 78A extends, cylinder 78B retracts, thereby creating a rotational displacement of front blade 72 which changes its angle in relation to the longitudinal axis of the snow groomer 60. Hence when button 24 is maintained actuated, a forward or backward motion of the multifunction joystick 10 actuates pitch hydraulic cylinder 79 which controls the pitch angle of front blade 72. A forward motion of the multifunction joystick 10 extends pitch hydraulic cylinder 79 and increases the pitch angle of front blade 72 while a rearward motion of the multifunction joystick 10 retracts pitch hydraulic cylinder 79 and decreases the pitch angle of front blade 72. When button 24 is released, the default mode of the control system is resumed and joystick 10 automatically provides control of the height and tilt angle of front blade 72.

Pressing button 27 and keeping it pressed disables the default mode of the multifunction joystick 10 as previously described. With button 27 pressed, the movements of joystick 10 serve to the adjustment of the two blade wings 71 and 73. A lateral motion of joystick 10 either retracts or extends hydraulic cylinder 83 thereby opening or closing the right blade wing 73. A fore-and-aft motion of joystick 10 either retracts or extends hydraulic cylinder 81 thereby opening or closing the left blade wing 71. Releasing button 27 reinstates the default mode of the control system.

The default mode of the control system and related joystick 10 and the modes associated with buttons 24 and 27 enable the operatorto control all the hydraulic cylinders necessary to manipulate and adjust the front blade 72.

In accordance with the present invention, the same control system and its multifunction joystick 10 are used to also control the rear work implements 64. Pressing button 23 and maintaining it pressed, disables the default rmode of multifunction joystick 10 and transfers the joystick controls to hydraulic cylinder 88 for the fore-and-aft motion of joystick 10 and to hydraulic cylinders 89 for the lateral motion of joystick 10. A forward motion of joystick 10 retracts the hydraulic cylinder 88 thereby increasing the depth of tilling of tiller 90. A rearward motion of joystick 10 extends the hydraulic cylinder 88 thereby decreasing the depth of tilling. A lateral motion of joystick 10 extends or retracts the two hydraulic cylinders 89 positioned atop tiller 90 thereby actuating the tiller rear flap 94 upward or downward to adjust the snow chamber 95 by increasing or decreasing its volume.

Pressing button 22 and maintaining it pressed, disables the default mode of joystick 10 and transfers the joystick controls to hydraulic cylinder 86 for fore-and-aft movement of joystick 10 and to the diagonally positioned hydraulic cylinder 87 for the lateral movement of joystick 10. Therefore, in this condition, a lateral movement of joystick 10 actuates hydraulic cylinder 87 and displaces tiller 90 towards the right or the left according to the motion of joystick 10. A fore-and-aft movement of joystick 10 raises or lowers tiller 90 and the rotation of tiller 90 is automatically stopped. If tiller 90 is not in the central position, when the raising command is given, tiller 90 will be automatically returned to the central position before it is raised.

By pressing button 26, tiller 90 is lowered onto the snow by its own weight by releasing the hydraulic pressure of hydraulic cylinder 86 and tiller 90 assumes a vertical floating mode which simply means that it is resting on the snow and will follow the vertical contours of the terrain. Tiller 90 starts rotating as it reaches the snow. Button 26 does not require to remain pressed and is not associated with any movements of joystick 10. The vertical floating mode will remain until button 26 is pressed again.

As part of the floating mode of tiller 90 previously mentioned, button 21 is provided to control the pressure of tiller 90 on the snow. Button 21 is coupled with an "up-down" selector switch on the dashboard of the snow grooming vehicle and to hydraulic cylinder 86. If the operator wishes to increase the pressure exerted by tiller 90 on the snow surface, he verifies that the "up-down" selector switch is at the "down" position, and presses button 21 until the pressure has built up sufficiently. Maintaining button 21 pressed builds up pressure in the hydraulic cylinder 86 to pull on tiller 90. In order to decrease the pressure exerted by tiller 90 on the snow surface, the "up-down" selector switch must be at the "up" position and then button 21 can be pressed to build pressure in hydraulic cylinder 86 in the opposite direction to push on tiller 90 thereby decreasing the pressure exerted by tiller 90 on the snow surface. Button 21 does not disable the default mode of multifunction joystick 10.

A further floating mode of tiller 90 is available. Button 25 is provided to render tiller 90 laterally floating which means that tiller 90 is free to move sideways and follow the various contours of the terrain. Button 25 in effect opens the hydraulic circuit of hydraulic cylinder 87 which enables the double-arm frame 85 to freely move laterally. This function of button 25 will remain "on" until a contradictory command is given. A lateral displacement command of tiller 90 or a raising command of tiller 90 with button 23 will disable the function of button 25. Button 25 does not disable the default mode of joystick 10.

Multifunction joystick 10 has therefore a default function which consist of raising and lowering front blade 72 and tilting it. Other functions previously described and associated with motion of multifunction joystick 10 could become the default function as may be required for proper functioning of snow groomer 60.

Figure 6:
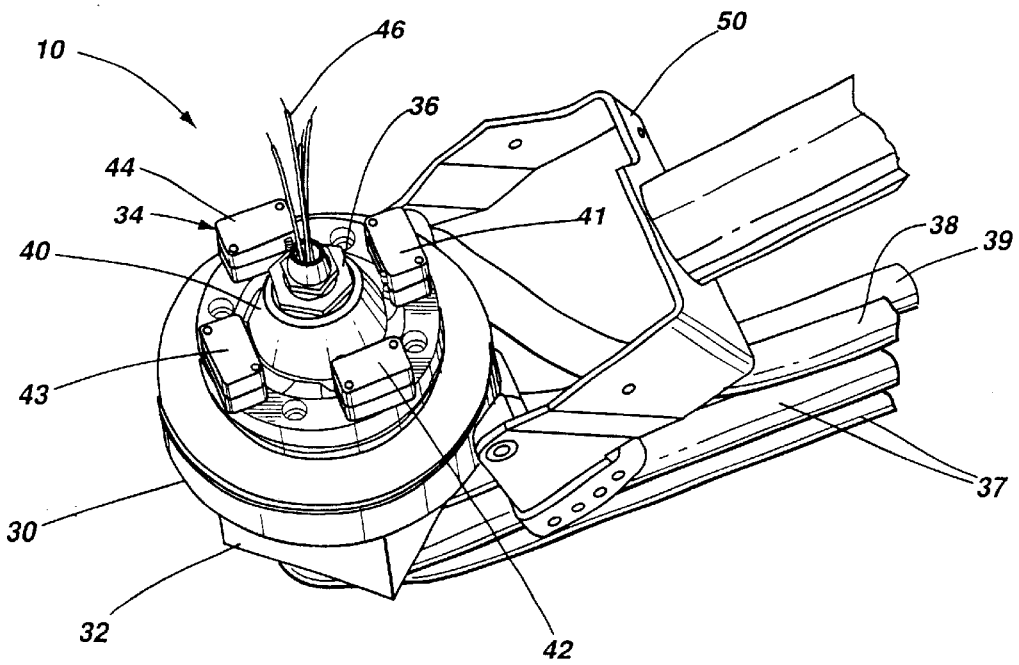
FIG. 6 is a perspective view illustrating a the multifunction joystick according to the invention with the handle portion removed.
Figure 7:
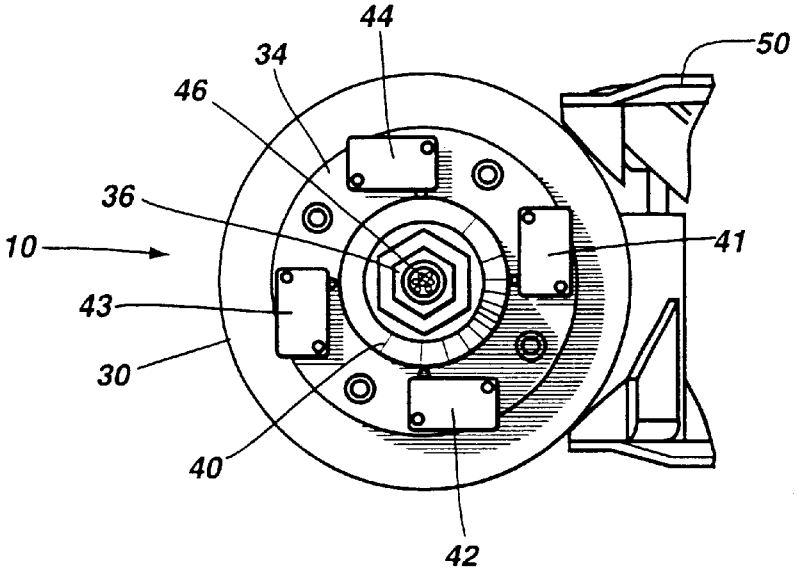
FIG. 7 is a top plan view of the multifunction joystick as shown in FIG. 6.
Figure 8:
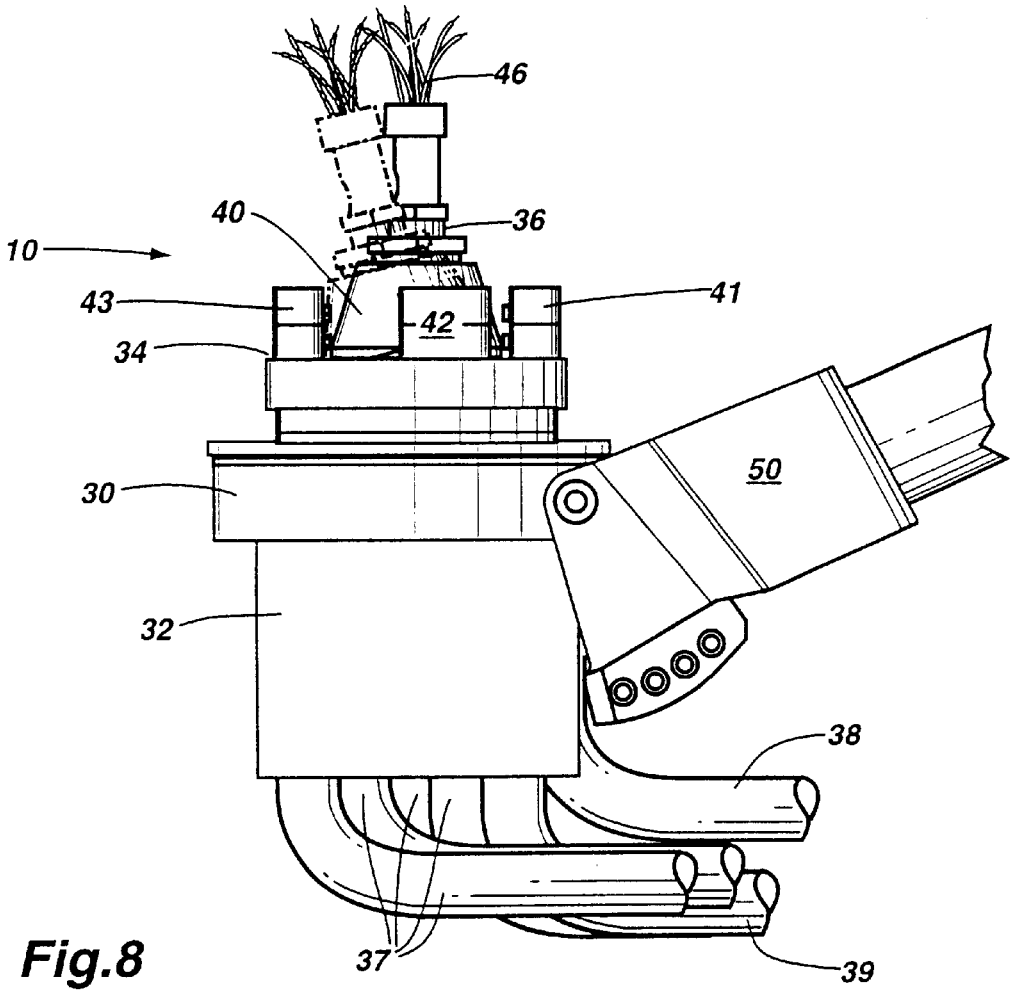
FIG. 8 is a side elevational view of the multifunction joystick as shown in FIG. 6 and 7.

Referring now to FIGS. 6, 7, and 8 which show joystick 10 with its handle removed from the shank 36, joystick 10 comprises an annular base 30 adjustably mounted to a fork-like support member 50. Joystick 10 comprises an hydraulic section 32 and an electrical section 34. The hydraulic section 32 comprises a standard four-way hydraulic valve (not shown) to which is mounted the shank 36. The four-way hydraulic valve is actuated when shank 36 is moved from its central neutral position and hydraulic fluid is directed in four possible directions. Hydraulic fluid enters the four-way hydraulic valve through an supply line 38 and exits the four-way hydraulic valve through at least one of four hydraulic lines 37 or through a drain line 39. When shank 36 remains in its neutral position, hydraulic fluid circulates from the supply line 38 to the drain line 39. If the shank 36 is moved in any direction, the four-way hydraulic valve directs hydraulic fluid towards an hydraulic cylinder either on the piston side to extend the hydraulic cylinder or on the shaft side to retract the hydraulic cylinder depending on the movement of the shank 36. In this particular embodiment of the invention, the hydraulic section of multifunction joystick 10 is the default function referred to earlier.

The electrical section 34 is mounted above the annular base 30 and comprises, in this example, four electrical transducers 41, 42, 43, and 44 positioned radially around shank 36 at equal angular spacing from each other. Shank 36 features a circular conical portion 40 provided to actuate the electrical transducers 41, 42, 43, and 44 as soon as shank 36 is moved from its central neutral position. A series of electrical wires 46 link each push buttons 21, 22, 23, 24, 25, 26, and 27 to the controller 100 (shown schematically in FIG. 9) so that when one of the push buttons is actuated, the electrical signal produces by this push button is receives as an input by the controller 100.

Electro-mechanical four-way hydraulic valves are used to control the various sets of implement actuators of the front work implement 62 or of the rear work implement 64 of the snow groomer. Controller 100 generates an output signal representative of the position of the multifunction joystick 10 which is sent to a specific electro-mechanical four-way hydraulic valve selected by one of the push buttons 22, 23, 24 or 27, which then directs the flow of hydraulic fluid to the specific set of hydraulic cylinders according to this output signal.

When any of the buttons 22, 23, 24 or 27 is pressed, the hydraulic fluid supply to supply line 38 is cut off by an electro-mechanical valve 105 (shown in FIG. 9) located upstream from multifunction joystick 10 thereby disabling the four-way hydraulic valve located in section 32 of multifunction joystick 10. When any of the buttons 22, 23, 24 or 27 is pressed, the electric signal produced by the actuation of any of the electrical transducers 41, 42, 43, or 44, is sent to the specific electro-mechanical four-way hydraulic valve associated with the button being pressed. Electrical transducers 41 and 43 will translate fore-and-aft motions of multifunction joystick 10, electrical transducers 42 and 44 will translate lateral displacement of multifunction joystick 10.

Buttons 21, 25, and 26 are more directly linked to the various electro-mechanical hydraulic valve since the function they perform is not dependant on the electrical transducers 41, 42, 43, and 44. They perform on-off functions of a rear hydraulic circuits and do not disable the default function of the multifunction joystick 10.

Figure 9:
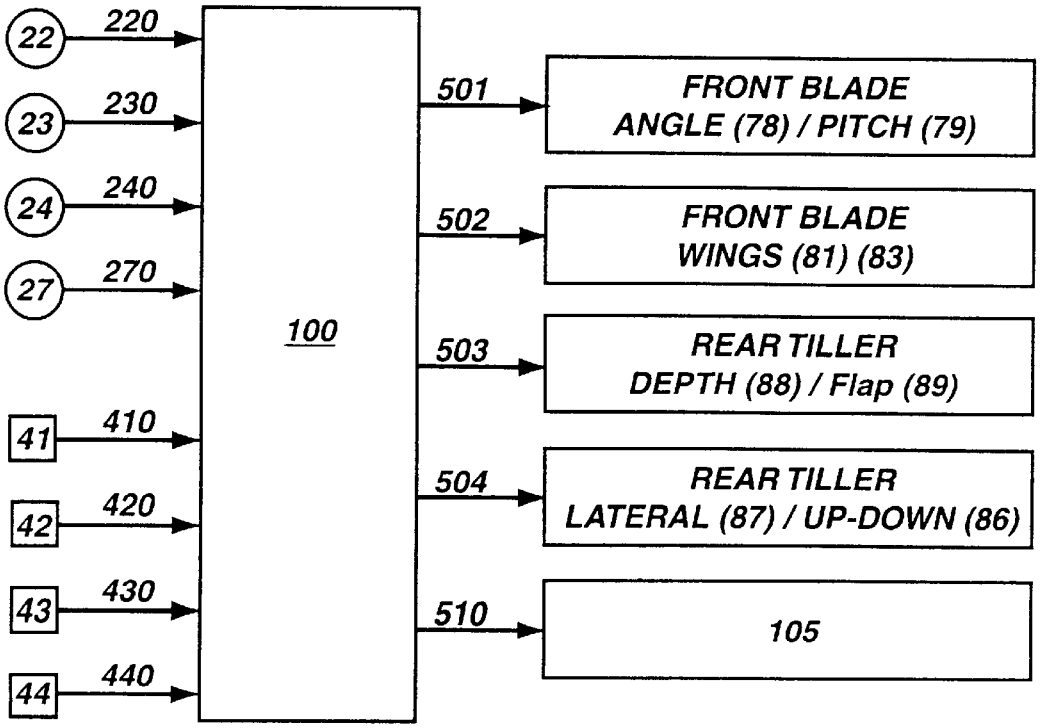
FIG. 9 is block diagram depicting the controller of the multifunction joystick according to the invention.

FIG. 9 represents a block diagram of a controller 100 adapted to receive signals generated by the electric transducers 41, 42, 43 and 44 and by buttons 22, 23, 24 and 27, and in response thereto generate an output signal which will actuate the various electro-mechanical valves controlling hydraulic cylinders 78 and 79, 81 and 83, 88 and 89, 86 and 87, and 105. As soon as one of the buttons 22, 23, 24, or 27 is actuated an output signal is sent to electro-mechanical valve 105 to disable the default mode of the multifunction joystick 10. Pressing one of the buttons 22, 23, 24 and 27 also selects one of the electro-mechanical valve controlling the hydraulic cylinders 78 and 79, 81 and 83, 88 and 89, 86 and 87. Controller 100 applies an output signal to the selected electro-mechanical valve which is representative of the electrical signal received from the electrical transducers 41, 42, 43, 44. For example, when push button 22 is pressed, an input signal 220 is sent to controller 100 which generates an output signal 510 to electro-mechanical valve 105 to disable the default mode. Input signal 220 is further interpreted by controller 100 to generate an output signal 504 representative of any input signals 410, 420, 430, and 440 or combinations thereof received from electric transducers 41, 42, 43 and 44 and to apply output signal 504 to the electro-mechanical valve controlling hydraulic cylinders 86 and 87. Controller 100 generates an output signal 510 as soon as any one of push buttons 22, 23, 24, and 27 is actuated. Controller 100 generates an output signal 503 to the electro-mechanical valve controlling the hydraulic cylinders 88 and 89 from an input signal 230 generated when button 23 is actuated. An output signal 501 to the electro-mechanical valve controlling the hydraulic cylinders 78 and 79 is generated by controller 100 from input signal 240 generated when button 24 is actuated. Controller 100 generates an output signal 502 to the electro-mechanical valve controlling the hydraulic cylinders 81 and 83 from input signal 270 generated when button 27 is actuated.

Controller 100 may made of a series of standard relays which are energized upon pressing any one of buttons 22, 23, 24, and 27. These relays respond to the condition of electrical transducers 41, 42, 43, and 44 and apply an electrical signal which actuates the various electro-mechanical four-way hydraulic valves. Controller 100 could also be easily achieved using a suitable micro processor relaying the various commands of multifunction joystick 10 to the various electro-mechanical four-way hydraulic valves.

In a particular embodiment of the invention, standard electrical transducers are use for translating joystick movement into signals to the electro-mechanical valves but other means are just as suitable. Position sensors, proximity sensors, hall-effect sensors, magnetic switches and so on may be used to perform the same tasks. Also, the electrical transducers are actuated by the circular conical portion 40 of shank 36. They could easily be positioned underneath a surface projecting from the shank 36 and actuated by this surface when the multifunction joystick 10 is moved in any direction. Other obvious means to produce a usable signal are possible without departing from the spirit of the invention.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A snow grooming vehicle comprising: a frame supported and propelled by ground engaging tracks; an operator's cabin mounted to said frame; implement coupling means for at least one snow working implement carried by said frame; at least two sets of implement actuators which are subject to operational control by the operator from within the operator's cabin; each set of implement actuators being controllable by a joystick independently of the control of any other set of implement actuators; an engine for driving said ground engaging tracks; said joystick having a hand grip portion positioned for convenient manipulation into various positions by the operator when sitting into said operator's cabin in a normal command position; electrical transducer means operatively associated with said joystick for generating an electrical signal representative of the position of said joystick; manual control switching means operable by the operator from its normal command position for selecting a set of implement actuators of which the operator desires to change the condition by means of said joystick thereby to adjust the position or setting of an implement according to the position of said joystick; a controller having at least two inputs and one output and generating an output signal representative of the position of said joystick for operatively controlling the set of implement actuators selected by the operator; said manual control switching means being coupled to a first input of said controller; the electrical signal produced by said electrical transducer means being coupled to a second input of said controller; whereby while said manual control switching means is actuated, said controller generates an output signal representative of the position of said joystick, which is used to operatively control a predetermined set of implement actuators; said joystick being adapted to control at least one other set of implement actuators when said manual control switching means is not actuated.

2. A snow grooming vehicle as defined in claim 1 wherein said at least one snow grooming implement comprises a front snow blade and wherein the other set of implement actuators which are controlled by said joystick when said manual control switching means is not actuated consists of a first hydraulic cylinder which sets the height of said front snow blade and a second hydraulic cylinder which sets the tilt angle of said front snow blade.

3. A snow grooming vehicle as defined in claim 2 wherein said first and second hydraulic cylinders are controlled by a set of hydraulic control valves which are mechanically linked to, and controlled by said joystick and rendered inoperative whenever said manual control switching means is actuated.

4. A snow grooming vehicle as defined in claim 3 wherein the set of implement actuators which are controlled by said joystick when said manual control switching means is actuated consists of a pair of hydraulic cylinders which adjust the angle of the front snow blade in relation to the longitudinal axis of said frame and a hydraulic cylinder which adjusts the pitch of said front snow blade.

5. A snow grooming vehicle as defined in any one of claim 1 to 4, wherein said manual control switching means comprises a plurality of electrical switches operable by the operator from its normal command position for selecting different sets of implement actuators of which the operator desires to change the condition thereby to adjust the position or setting of an implement.

6. A snow grooming vehicle as defined in claim 5, further comprising a third set of implement actuators which are controlled by said joystick when a second electrical switch is actuated, said third set of implement actuators consisting of a pair of hydraulic cylinders which adjust the angle of wings attached to both sides of said front snow blade.

7. A snow grooming vehicle as defined in claim 5, further comprising a second snow grooming implement located at the rear of said snow grooming vehicle.

8. A snow grooming vehicle as defined in claim 7, wherein said second snow grooming implement consists of a snow tiller having a fourth set of implement actuators which are controlled by said joystick when a third electrical switch is actuated, said fourth set of implement actuators consist of a pair of hydraulic cylinders which operate a flap located behind said snow tiller for adjusting the volume of a snow chamber defined by said snow tiller and an hydraulic cylinder which adjust the depth of said snow tiller.

9. A snow grooming vehicle as defined in claim 8, wherein said snow tiller further comprises a fifth set of implement actuators which are controlled by said joystick when a fourth electrical switch is actuated, said fifth set of implement actuators consist of a hydraulic cylinder which laterally adjusts the position of said snow tiller in relation to the central longitudinal axis of said frame and a hydraulic cylinder which adjusts the height of said snow tiller.

10. A snow grooming vehicle as defined in claim 1, wherein said manual control switching means comprises a plurality of push button on the hand grip portion of said joystick.

11. A multifunction joystick control system for a snow grooming vehicle which has a frame, ground engaging tracks, an operator's cabin, an engine for driving said vehicle, implement coupling means for at least one snow grooming implement and at least two sets of implement actuators separately controlled by the operator, each set of implement actuators being controllable by a joystick; said multifunction joystick control system comprising:

a joystick having a hand grip portion positioned for convenient manipulation by the operator into various positions when sitting into said operator's cabin in a normal command position;

a set of electrical transducers operatively associated with said joystick for generating an electrical signal representative of the position of said joystick;

a first manual control switching means operable by the operator from said normal command position for selecting a first set of implement actuators that the operator desires to operationally control, said first manual control switching means generating an electrical signal representative of said first set of implement actuators;

a controller having at least two inputs and one output and generating an output signal for effecting the operational control of the set of implement actuators selected by the operator;

said electrical signal generated by said first manual control switching means being coupled to a first input of said controller;

said electrical signal generated by said set of electrical transducers being coupled to a second input of said controller;

said controller generating a first output signal when said first manual control switching means is actuated, said first output signal being representative of the position of said joystick and being used to control the operation of said first set of implement actuators;

said multifunction joystick control system being adapted to control the operation of at least one other set of implement actuators as a function of the position of said joystick when said first manual control switching means is not actuated.

12. A multifunction joystick control system as defined in claim 11, wherein said other set of implement actuators consists of a set of hydraulic cylinders which require control by the operator for proper operation of said utilitarian vehicle; said multifunction joystick control system also comprising a hydraulic circuit for operating said hydraulic cylinders, control valve means operatively associated with said joystick for controlling hydraulic fluid supply through said hydraulic circuit to said hydraulic cylinders as a function of the position of said joystick and disabling means for disabling said control valve means when said first manual control switching means is actuated.

13. A multifunction joystick control system as defined in claim 11, further comprising:

a hydraulic valve operatively associated with said joystick for controlling the actions of an implement;

a supply line connected to said hydraulic valve for delivering hydraulic fluid to said hydraulic valve, said supply line having an electro-mechanical valve;

said first input of said controller generating a second output signal for actuating said electro-mechanical valve to prevent delivery of said hydraulic fluid to said hydraulic valve thereby disabling said hydraulic valve whenever said manual control switching means is actuated.

14. A multifunction joystick control system as defined in claim 13, wherein said hydraulic valve is enabled when said manual control switching means is not actuated by the operator.

15. A multifunction joystick control system as defined in any one of claims 11 to 14, wherein said manual control switching means comprises at least one push button located on said hand grip portion of said joystick.

16. A multifunction joystick control system as defined in claim 15, wherein said electrical transducers are disposed in an equidistant circular configuration around the shank of said joystick, at least when said joystick is in the central position, and wherein at least one transducer is actuated when said joystick is moved in any direction away from said central position.

17. A multifunction joystick control system as defined in claim 15, wherein said set of electrical transducers consists of four electrical switches.

18. A multifunction joystick control system for a utilitarian vehicle having at least one implement and at least two sets of implement actuators which are subject to operational control by the operator from within an operator's cabin in said utilitarian vehicle; each set of implement actuators being controllable by a joystick independently of the control of any other set of implement actuators; said multifunction joystick control system comprising:

a joystick having a hand grip portion positioned for convenient manipulation by the operator into various positions when sitting into said operator's cabin in a normal command position;

a set of electrical transducers operatively associated with said joystick for generating an electrical signal representative of the position of said joystick;

a first manual control switching means operable by the operator from said normal command position for selecting a first set of implement actuators that the operator desires to operationally control, said first manual control switching means generating an electrical signal representative of said first set of implement actuators;

a controller having at least two inputs and one output and generating an output signal for effecting the operational control of the set of implement actuators selected by the operator;

said electrical signal generated by said first manual control switching means being applied to a first input of said controller;

said electrical signal generated by said set of electrical transducers being applied to a second input of said controller;

said controller generating a first output signal when said first manual control switching means is actuated, said first output signal being representative of the position of said joystick and being used to control the operation of said first set of implement actuators; said multifunction joystick control system being adapted to control the operation of at least one other set of implement actuators when said first manual control switching means is not actuated.

19. A multifunction joystick control system as defined in claim 18, wherein said other set of implement actuators consists of a set of hydraulic cylinders which require control by the operator for proper operation of said utilitarian vehicle, said multifunction joystick control system also comprising an hydraulic circuit for operating said hydraulic cylinders; control valve means operatively associated with said joystick for controlling hydraulic fluid supply though said hydraulic circuit to said hydraulic cylinders as a function of the position of said joystick and disabling means for disabling said control valve means when said first manual control switching means is actuated.

20. A multifunction joystick control system as defined in claim 18, further comprising:

a hydraulic valve operatively associated with said joystick for controlling the actions of an implement;

a supply line connected to said hydraulic valve for delivering hydraulic fluid to said hydraulic valve, said supply line having an electro-mechanical valve;

said first input of said controller generating a second output signal for actuating said electro-mechanical valve to prevent delivery of said hydraulic fluid to said hydraulic valve thereby disabling said hydraulic valve whenever said manual control switching means is actuated.

21. A multifunction joystick control system as defined in claim 20, wherein said hydraulic valve is enabled when said manual control switching means is not actuated by the operator.

22. A multifunction joystick control system as defined in any one of claims 18 to 21, wherein said manual control switching means comprises at least one push button located on said hand grip portion of said joystick.

23. A multifunction joystick control system as defined in claim 22, wherein said electrical transducers are disposed in an equidistant circular configuration around the shank of said joystick, at least when said joystick is in the central position, and wherein at least one transducer is actuated when said joystick is moved in any direction away from said central position.

24. A multifunction joystick control system as defined in claim 23, wherein said set of electrical transducers consists of four electrical switches.

25. A snowgrooming vehicle comprising an internal combustion engine, a frame, an operator's cabin supported by said frame, a set of ground engaging tracks, a drive mechanism linking said internal combustion engine to said ground engaging tracks enabling said snow grooming vehicle to move on snow, implement coupling means for at least one implement, said at least one implement being subject to functional control by the operator from within said operator's cabin, a multifunction joystick control system for selectively controlling an implement carried by said implement coupling means, said multifunction joystick control system comprising a joystick having a hand grip portion positioned for convenient manipulation by the operator when sitting into said operator's cabin in a normal command position, manual control switching means operable by the operator from said normal command position for selecting a function of an implement that the operator desires to control by normal bi-axial manipulation of said joystick, a controller for generating an output signal which is used for effecting the operational control of the function of an implement selected by the operator whenever said manual control switching means is actuated; said multifunction joystick control system being adapted to also control the operation of at least one other function of an implement by normal bi-axial manipulation of said joystick while said manual control switching means is not actuated.

26. A snowgrooming vehicle as defined in claim 25, wherein said multifunction joystick control system further comprises a set of electrical transducers operatively associated with said joystick for generating an electrical signal representative of the position of said joystick, said electrical signal generated by said set of electrical transducers being coupled to a second input of said controller.

27. A snowgrooming vehicle as defined in claim 26, wherein said manual control switching means generates an electrical signal representative of the selected function of an implement, said electrical signal generated by said manual control switching means being coupled to a first input of said controller.

28. A snowgrooming vehicle as defined in claim 27, wherein said controller generates said output signal as a function of said first and second input signals, said output signal being applied to the selected function of an implement for operationally controlling its action.

29. A snowgrooming vehicle as defined in claim 28, wherein said at least one implement, in operation, is actuated by at least one hydraulic cylinder, said at least one hydraulic cylinder being controlled by an electro-mechanical hydraulic valve.

30. A snowgrooming vehicle as defined in claim 29, wherein said electro-mechanical hydraulic valve is actuated by said output signal generated by said controller.

31. A snowgrooming vehicle as defined in claim 30, wherein said manual control switching means comprises at least one push button located on said hand grip portion of said joystick.

32. A snowgrooming vehicle as defined in claim 31, wherein said at least one implement is a front snow blade whose height and tilt angle are controlled by said joystick when said manual control switching means is not actuated.

33. A snowgrooming vehicle as defined in any one of claims 25 to 31, further comprising a snow tiller controlled by said joystick.

34. A multifunction joystick for controlling a plurality of independent operations of implements, comprising:

a handle mounted on a movable shank;

a signal actuator positioned adjacent to the shank and connected to a controller; and a hydraulic actuator coupled to the shank and connected to a hydraulic system;

wherein the handle is selectively movable to actuate the hydraulic actuator and to actuate the signal actuator to control operation of the implements based on a position of the shank.

35. The joystick of claim 34, wherein the handle has a plurality of mechanical switches connected to the controller that are selectively operable to control operation of the implements.

36. The joystick of claim 35, wherein at least one mechanical switch actuates the controller to select between implements.

37. The joystick of claim 35, wherein at least one mechanical switch actuates implement functions in cooperation with signals from the signal actuator.

38. The joystick of claim 35, wherein at least one mechanical switch disables the hydraulic actuator.

39. The joystick of claim 35, further comprising an electo-mechanical actuator in connection with the hydraulic system and in connection with the controller, wherein at least one of the mechanical switches controls the electro-mechanical actuator to disable the hydraulic system.

40. The joystick of claim 35, wherein at least one mechanical switch operates independently of the hydraulic actuator.

41. The joystick of claim 34, wherein the signal actuator is an electrical actuator.

42. The joystick of claim 41, wherein the electrical actuator comprises a plurality of electrical transducers positioned around the shank.

43. The joystick of claim 42, wherein the shank includes a conical portion that selectively contacts an electrical transducer to actuate the transducer to send a signal representative of a position of the handle to the controller.

44. The joystick of claim 34, further comprising an electro-mechanical hydraulic actuator connected to other hydraulic systems and to the controller that receives signals from the controller based on actuation of the signal actuator by movement of the handle.

45. The joystick of claim 44, wherein the handle has a plurality of mechanical switches connected to the controller that are selectively operable to signal the controller to select an implement or function to be controlled by the signal actuator.

46. The joystick of claim 34, wherein the hydraulic actuator comprises a four-way hydraulic valve that selectively directs hydraulic fluid to an implement.

47. The joystick of claim 34, in combination with a vehicle having a plurality of work implements.

48. The joystick of claim 47, wherein the plurality of work implements include a front work implement and a back work implement, each capable of operating in various modes and positions.

49. The joystick of claim 47, wherein the vehicle is a tracked vehicle and at least one of the work implements is useable to groom snow.

* * * * *